United States Patent [19]

Dittmann

[11] Patent Number: 4,684,909

[45] Date of Patent: Aug. 4, 1987

[54] ELECTROMAGNETIC RELAY

[75] Inventor: Michael Dittmann, Berlin, Fed. Rep. of Germany

[73] Assignee: Siemens Aktiengesellschaft, Berlin & Munich, Fed. Rep. of Germany

[21] Appl. No.: 840,653

[22] Filed: Mar. 18, 1986

[30] Foreign Application Priority Data

Mar. 26, 1985 [DE] Fed. Rep. of Germany ..... 3510966

[51] Int. Cl.[4] ..... H01H 67/02

[52] U.S. Cl. ..... 335/128; 335/133; 335/185; 335/203

[58] Field of Search ..... 335/83, 85, 124, 128, 335/133, 135, 185, 187, 202, 203

[56] References Cited

U.S. PATENT DOCUMENTS 3,588,765 8/1968 Alten et al. ..... 335/203
3,781,729 12/1973 Hayden .
4,393,359 7/1983 Schreiner et al. ..... 335/128
4,517,537 5/1985 Weiser et al. .

FOREIGN PATENT DOCUMENTS 2021455 5/1970 Fed. Rep. of Germany .
1926188 9/1970 Fed. Rep. of Germany .
1440359 9/1974 United Kingdom .

*Primary Examiner*—E. A. Goldberg
*Assistant Examiner*—Lincoln D. Donovan
*Attorney, Agent, or Firm*—Hill, Van Santen, Steadman & Simpson

[57] ABSTRACT

An electromagnetic relay has a coil body with a core yoke formed from flat stock with a core leg extending through the coil body. A yoke leg, also formed from the same piece of flat stock, is disposed over or next to the coil in a plane which is at a right angle relative to the plane of the core leg. An armature is disposed at the free end of the yoke leg, forming a working air gap with the free end of the yoke leg and being mounted for movement on a leaf spring pivotable about a bearing location. The free end of the armature forms the contact spring which cooperates with a stationary contact element. A connection element functioning as a terminal is also integrally formed from the same piece of flat stock. Additional coil connection elements are secured in the coil body by being plugged therein. The relay assembly is mounted on a base which forms a portion of the housing in combination with a cap placed over the base covering the assembly.

18 Claims, 19 Drawing Figures

83
81
80

XIV
XV
85
63
83
61
71
62
77a
76a
82
75a
74a 80
77
81

80
83
81
85
76

ELECTROMAGNETIC RELAY

BACKGROUND OF THE INVENTION

1. Field of the Invention

The present invention relates to electromagnetic relays, and in particular to so-called "flat" relays wherein a core leg extends axially through the coil winding.

2. Description of the Prior Art

Electromagnetic relays are known in the art having a coil body with a winding thereon and having a core yoke formed in one piece from a flat ribbon or tape stock with at least two legs, one core leg being plugged in the axial direction through the coil member and one yoke leg extending parallel to the coil axis either next to or above the coil winding. Such relays have a flat armature with one end mounted on a leaf spring at the free end of the yoke leg, and the other end forming an air gap opposite the free end of the core leg. The leaf spring is connected to the core yoke by a terminal element, and the free end extends beyond the moveable armature and functions as a contact spring in cooperation with at least one stationary cooperating contact element.

A relay as described above is disclosed in U.S. Pat. No. 3,781,729. In that relay, the core yoke is bent in a U-shape from a ribbon or flat tape, and the free end of the yoke leg, which is angled toward the exterior, carries a flat armature by means of a leaf spring. The flat armature forms a working air gap with the narrow end face of the core leg. The coil in this relay is mounted to a relay base only by means of the angled projection of the yoke leg. The base receives stationary contact elements at a side opposite therefrom. This structure makes tolerances between the armature, the core pole face, and the contact elements difficult to control, and relatively complicated adjustment of the various components is necessary in virtually every unit. Additionally, the arrangement of the coil in this relay, with an axis disposed perpendicularly with respect to the plane of the relay base, results in an unfavorable three dimensional structure, wherein a relatively wide housing having a large, but only partially used, interior volume is necessary.

SUMMARY OF THE INVENTION

It is an object of the present invention to provide a relay with a one-piece stock element having a core leg extending through the coil winding and a yoke leg disposed outside of the coil winding which has a compact structure which is narrow along one axis, with the narrow axis being capable of being disposed in different planes relative to the relay base without substantial basic structural modification of the overall arrangement, i.e., it is an object of the present invention to provide a basic relay structure which can be used to manufacture an upright relay having a very small width or a flat relay having a very low height.

It is a further object of the present invention to provide such a compact relay which can be sealed in a housing in a simple manner.

It is another object of the present invention to provide such a relay which has a low-tolerance arrangement of the armature, the core and the contact elements so that subsequent adjustment is either avoided or substantially minimized.

The above objects are inventively achieved in an electromagnetic relay having a coil with a coil axis extending parallel to the terminal or base plane of the relay, a unitary element having a yoke leg and a core leg with the yoke leg bent so as to be disposed in a plane which is substantially perpendicular to the plane containing the core leg, with the bend being crimped such that the center line of the yoke leg is aligned with the plane containing the core leg, and an armature mounted on a leaf spring for pivotal movement around the coil axis, the armature facing the core leg forming a working air gap therewith, and the leaf spring carrying a contact element for making and breaking with a stationary cooperating contact element disposed in the plane containing the core leg and mounted in the relay base.

A particularily narrow relay structure can be achieved wherein the unitary element is sheet material with the core and yoke legs being respectively cut therein, and the yoke leg being bent by 90°, with the yoke leg extending outside of the coil winding and the width of the yoke leg being substantially coextensive with the narrow side of the wound coil. As stated above, the armature is seated at the yoke leg by a leaf spring, and the flat side of the armature forms a working air gap of large area in combination with the flat side of the core leg. By inserting the unitary element in the coil body and in the terminal plane of the relay, and by similarly inserting the stationary contact element in the terminal plane of the relay, the leaf spring carrying the armature automatically assumes the correct contact distance with respect to the stationary contact element without substantial adjustment, thereby achieving an arrangement which is substantially insensitive to tolerance variations.

The leaf spring simultaneously functions as a bearing spring for the armature and a contact spring. A connecting element for the leaf spring can be attached to the yoke leg, which has stated above is in turn inserted in the coil body, so that by simply plugging the coil body into the relay base, a simplified assembly procedure is achieved. The only further step necessary is insertion of the coil terminal pins. The relay is contained in a two-piece housing, one of the pieces being the aforementioned relay base, consisting of plastic and sealed in the standard manner.

The same basic structure described above can be also used to construct a relay standing on edge with a narrow base area. In this embodiment, the plane containing the core leg is disposed perpendicularly with respect to the terminal plane of the relay, and the connection elements for the leaf spring and the cooperating contact element extends in the same plane as the core leg. The connecting element for the leaf spring may be integrally attached to a further leg which is part of the unitary element including the core leg and the yoke leg. The connecting element may, however, alternatively be subsequently connected to the core yoke by welding or other attachment methods, as needed.

In a further embodiment of a flat relay having a low height, the plane containing the core leg extends parallel to the terminal plane of the relay, and a connection member of the cooperating contact element is angled at a direction perpendicular to the terminal plane. A connection element for the leaf spring is integrally applied to the yoke leg in the principal plane thereof, or may be subsequently attached thereto.

For seating the armature, the coil body in a further embodiment of the relay may have a bearing edge for the armature disposed in the region of the free end of the yoke leg. The coil body may have plug-in grooves proceeding from the end face for receiving the cooperating contact element in one of the coil flanges, and for receiving the core yoke and two coil terminal elements in the region of the opposite coil flange. Both the coil terminal elements and the connection elements for the contact spring and the cooperating contact element are guided in recesses to the connection plane of the relay.

Seating of the armature may also be undertaken by forming a bearing notch by a combination of the free end of the yoke leg with a laterally angled tab. The armature is seated in the bearing notch by an integrally attached bearing blade. In this embodiment, it is preferably that the bearing notch is disposed beyond the principal plane of the core leg and armature, and that the bearing notch is disposed at an angle bearing section of the armature.

The contact arrangement of the relay can be structured such that the free end of the leaf spring attached to the armature extends substantially in a plane and forms a make contact with the stationary cooperating contact element. The contact spring may, however, be crimped such that, between the free end of the armature and the stationary cooperating contact element, it intersects the common plane between the armature and the cooperating contact element, forming a break contact with the cooperating contact element.

As described above, the relay housing is preferably formed in two pieces. In one embodiment, a pedestal is provided on one of the parts, accepting the terminal elements and the coil and being covered with an inverted protective cap. In another embodiment, the housing may be formed by two essentially identical halves having a separating plane extending perpendicularly with respect to the connecting or terminal plane of the relay. In this embodiment, the connection elements for the leaf spring, for the cooperating contact element and for the coils terminals disposed in one plane are preferably clamped in the separating plane between the two housing halves. A space for receiving additional components can be formed in the housing or in the coil body as needed.

DESCRIPTION OF THE PREFERRED EMBODIMENTS

Figure 1:
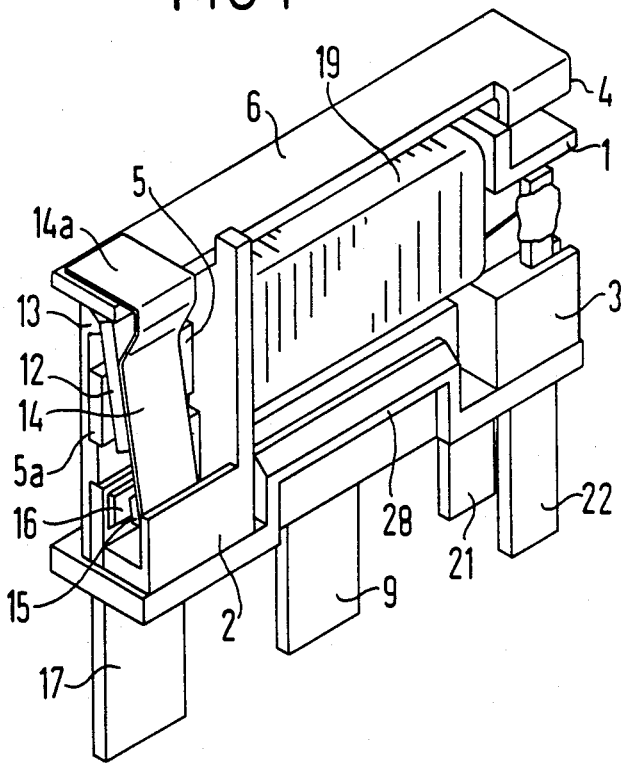
FIG. 1 is perspective view of a first embodiment of an electromagnetic relay constructed in accordance with the principles of the present invention with the housing cover removed.

A first embodiment of an electromagnetic relay constructed in accordance with the principles of the present invention is shown in various views in FIGS. 1 through 5. The relay has a coil body 1 with spaced flanges 2 and 3. The flanges 2 and 3 have a plurality of plug-in grooves for receiving other components of the relay, as described below. A unitary core yoke element 4 is cut and formed from one piece of flat sheet stock such as ribbon or tape. The core yoke element 4 includes an elongated core leg 5 and a yoke leg 6 extending parallel to the core leg 5. The yoke leg 6 is disposed in a plane perpendicular to the plane containing the core leg 5, formed by rotating the yoke leg 6 through 90° by a crimp and a bend 7, such that a center line **6*a* of the yoke leg 6 is substantially in the plane containing the core leg 5. The core yoke element 4 also has a connection leg 8 at a lower portion thereof extending parallel to and coplanar with the core leg 5. The connection leg 8 has a connection tab 9** extending downwardly perpendicular to the terminal plane of the relay.

After the coil body 1 has been wound with a coil, the core yoke element 4 is plugged into the coil body 1 in the axial direction, with the core leg 5 being inserted into an axial opening 10 in the coil body 1, so that its free end **5*a* is received in a recess 11 of the coil flange 2. A defined pull face for an armature 12 is, thus, formed. The armature 12 is seated at an inside region 6*b* of the yoke plate 6 facing the core leg 5, and extends perpendicular to the axial direction of the coil in the region of the coil flange 2, forming a working air gap with the free end 5*a* of the core leg 5. The armature 12 is attached to a leaf spring 14 so as to be pivotable on a bearing edge 13** of the coil body around an axis parallel to the coil axis.

The leaf spring 14 holding the armature 12 functions both as an armature bearing spring and a contact spring. The leaf spring 14 has a section **14*a* attached to the yoke leg 6 by welding or other suitable means, and a free end 14*b* extending beyond the end of the armature 12 at which a contact pad 15 is attached. The contact pad 15 is disposed opposite a contact pad 16 of a stationary cooperating contact element 17, which is inserted in a plug-in groove 18 of the coil body flange 2. Because the groove 18 for the cooperating contact element 17, as well as the recess 11 for the free end 5***a* of the core leg 5 are fashioned in the coil body 1, the groove 18 and the recess 11 forming coplanar seating surfaces for those respective elements, a defined position of the pull face 5*b* with respect to the surface of the cooperating contact element 17 is achieved. The leaf spring 14 carrying the armature 12 assumes the proper contacting distance without subsequent adjustment.

Figure 4:
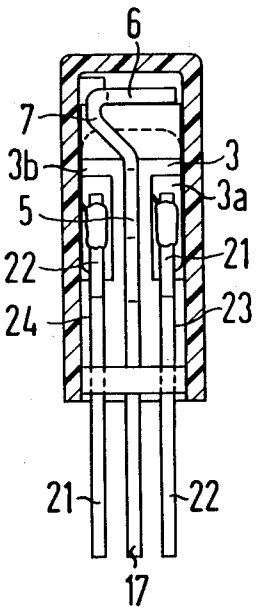
FIG. 4 is another end sectional view, taken along line IV—IV, of FIG. 2.
Figure 2:
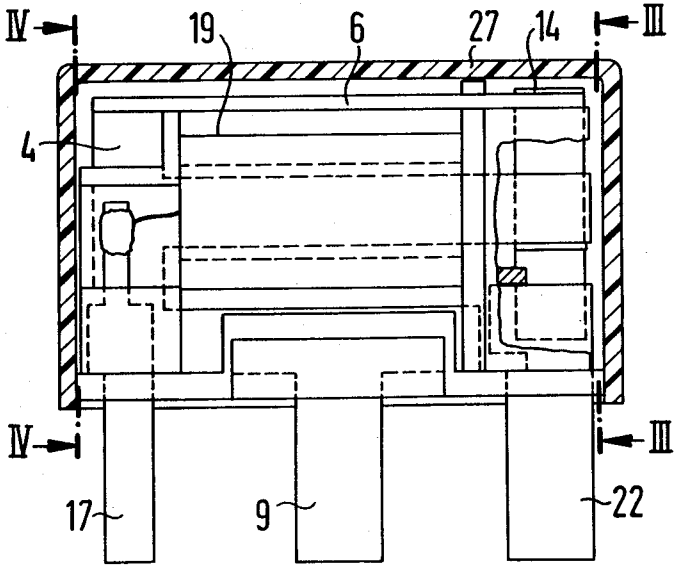
FIG. 2 is a sectional view (with housing cover) of the relay shown in FIG. 1.
Figure 3:
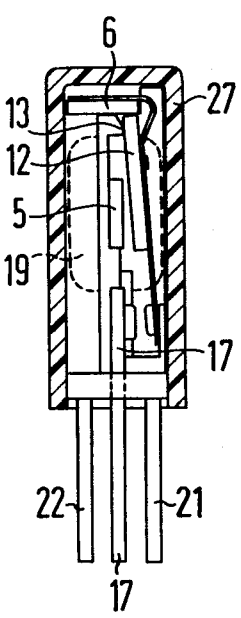
FIG. 3 is an end sectional view taken along line III—III of FIG. 2.
Figure 5:
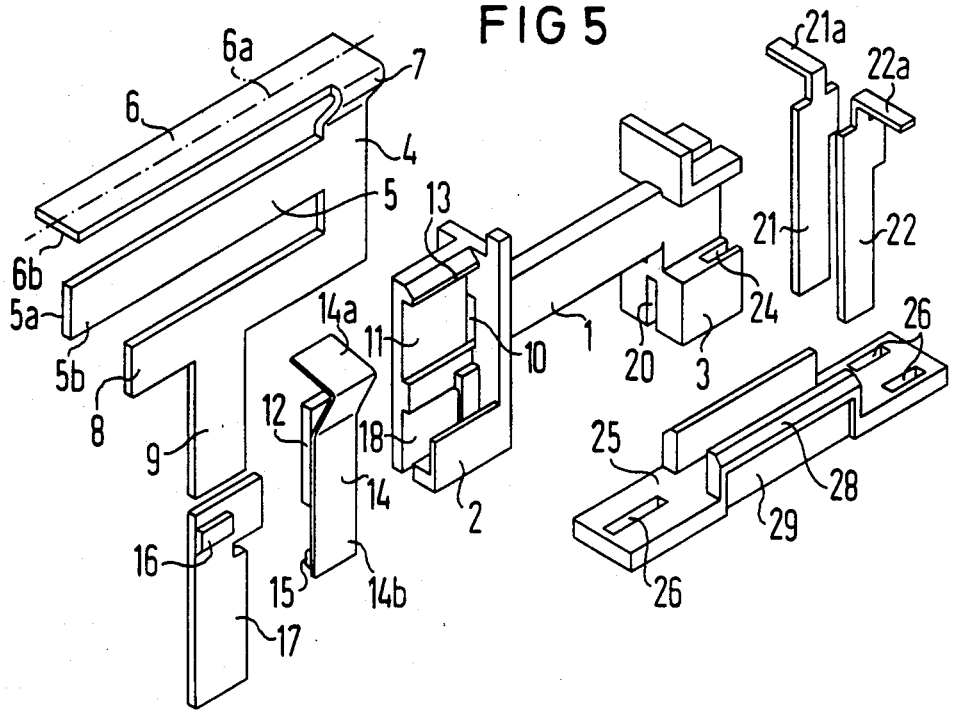
FIG. 5 is an exploded view of the relay shown in FIG. 1.
Figure 6:
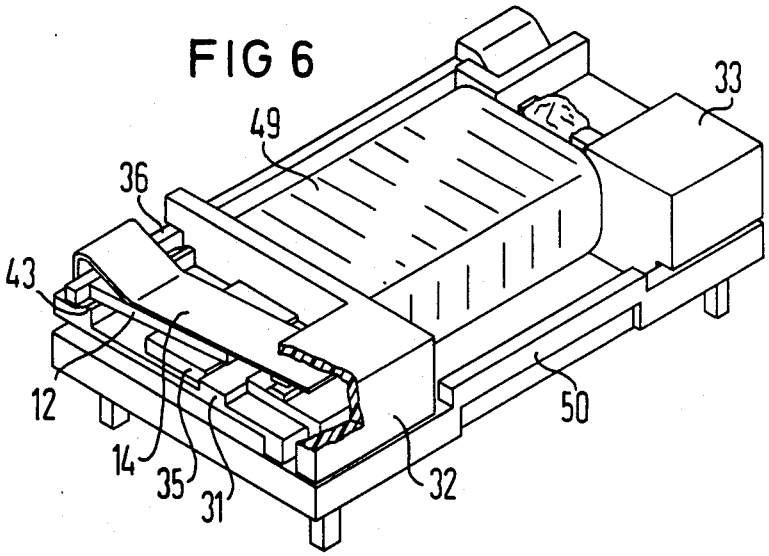
FIG. 6 is a perspective view of a second embodiment of an electromagnetic relay constructed in accordance with the principles of the present invention with the housing cover removed.

After mounting the core yoke element 4, the yoke leg 6 is disposed centrally above the narrow side of a winding 19 applied to the coil body 1, so that as narrow as possible a structure is achieved. The connecting leg 8 is disposed coplanar with the cooperating contact element 17 in a groove 20, and coil connection elements 21 and 22 are secured by being plugged in respective grooves 23 and 24 of the coil body flange 3. Upper ends 21*a* and 22*a* of the respective coil connection elements 21 and 22 are angled toward the outside of the relay in order to enable an easy winding start for the coil ends, as shown in FIG. 5. Subsequently, the ends 21*a* and 22*a* are bent into recesses 3*a* and 3*b* of the coil body flange 3, as shown in FIG. 4.

At the connection side of the relay, a base 25 with a plurality of openings 26 is attached with the cooperating contact element 17, the connection tab 9, and the coil connection elements 21 and 22 extending therethrough to the exterior of the relay. A cap 27 is then placed over the base 25, and the edge grooves between the base 25 and the cap 27 as well as the openings 26 are sealed with casting compound.

As stated above, the embodiment shown in FIGS. 1 through 5 is for a narrow upright relay. A low flat relay using the same basic internal construction is shown in various views in FIGS. 6 through 11. This relay has a very low structural height. The relay of FIGS. 6 through 11 has a coil body 1 with spaced flanges 32 and 33 formed in the same manner as the coil body 1 of the embodiment discussed above. A core yoke element 34 is plugged into the coil body 31, the core yoke element 34 having a core leg 35 and a yoke leg 36. The yoke leg 36 is rotated through 90° with respect to the core leg 35 and is connected thereto by a crimp 37. The core leg 35 is received in the coil body 31 in an axial opening 40 therein, whereas the yoke leg 36 extends laterally outside of the winding. The center line 36*a* of the yoke leg 36 is substantially contained in the plane containing the core leg 35. The yoke leg 36 terminates in a nose 36*b* at its free end which engages a projection 31*a* of the coil body 31.

The leaf spring/armature structure in the embodiment of FIGS. 6 through 11 is identical to that employed in the embodiment of FIGS. 1 through 5, therefore the same reference symbols are utilized. As in the first embodiment, the section 14*a* of the leaf spring 14 functions for holding the armature 12, and its free end 14*b* functions as a contact spring carrying a contact pad 15.

Because the relay of the embodiment of FIGS. 6 through 11 is not standing on end, but is instead flat, the terminal for the leaf spring is not disposed in the plane of the core leg 35, but instead is in the form of a terminal pin 39 in the plane of the yoke leg 36. A stationary cooperating contact element 45 having a contact pad 46 is mounted parallel to the leaf spring 14, spaced therefrom, and has a downwardly extending terminal pin 47. The cooperating contact element 45 is received in a groove 48 of the coil body flange 32.

Figure 9:
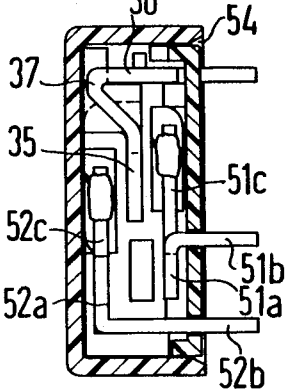
FIG. 9 is a sectional view taken laterally at a different location then the sectional view shown in FIG. 8 along FIG. 7.
Figure 7:
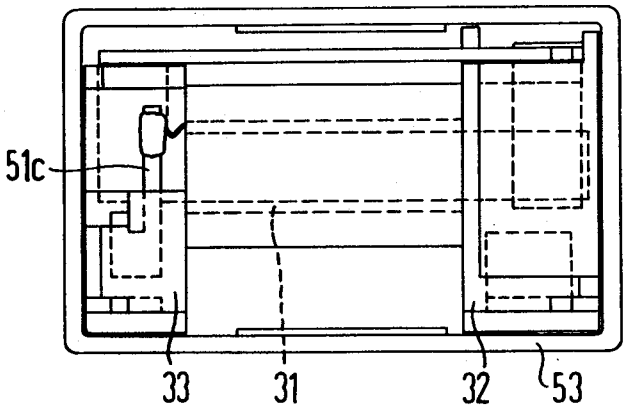
FIG. 7 is a plane view of the relay shown in FIG. 6.
Figure 10:
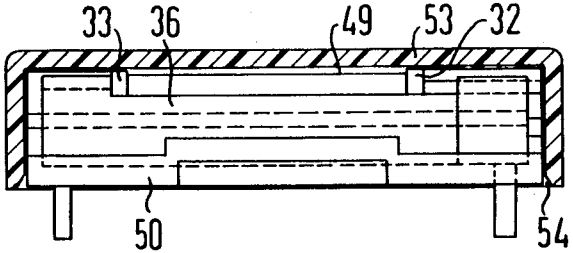
FIG. 10 is a sectional view taken longitudinally along FIG. 7.
Figure 8:
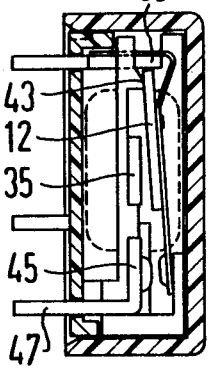
FIG. 8 is a sectional view taken laterally along FIG. 7.
Figure 11:
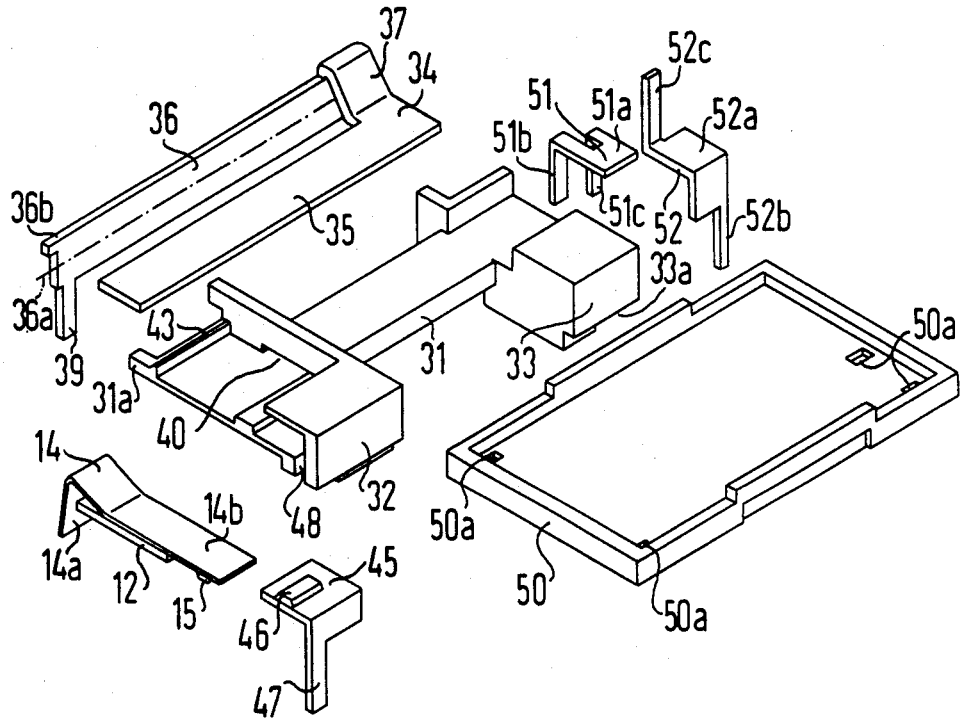
FIG. 11 is an exploded view of the electromagnetic relay assembly shown in FIG. 6.

After the core yoke element 34 and the cooperating contact element 45 have been plugged into their respective positions, and after the leaf spring 14 carrying the armature 12 has been attached, the coil body 31 is provided with a winding 49 and is mounted on a base 50, with terminal pins 39 and 47 extending through respective openings 50*a* of the base 50. Coil connection elements 51 and 52 are disposed at the coil flange 33 and are also inserted through other openings 50*a* of the base 50. The center portions of the connection elements 51 and 52 are disposed parallel to the plane of the base 50, i.e., section 51*a* is disposed in a recess 33*a* below the coil flange 33, and section 52*a* is disposed flat against a surface 33*a* of the coil flange 33. Solder terminal pins 51*b* and 52*b* are bent perpendicularly with respect to the base plane and are plugged through the corresponding openings 50*a* of the base 50. Winding pins 51*c* and 52*c* for receiving the coil ends are bent at right angles for winding the coil in order to enable an easier start of winding. The pins 51*c* and 52*c* are subsequently bent into a plane parallel to the base plane of the relay, and are, thus, introduced with the coil body 31 into the base 50, as best seen in FIG. 9. The relay is closed with a cover 53 which overlaps the base 50, and the edge seam 54 and openings 50*a* are sealed with casting compound in a standard manner.

Another embodiment of the electromagnetic relay constructed in accordance with the principles of the present invention is shown in various views in FIGS. 12 through 17. The basic structure is similar to the embodiment shown in FIGS. 1 through 5. In this embodiment, the coil body 61 has an upright center portion having substantially rectangular cross-section with flanges 62 and 63 at opposite ends thereof having plug-in grooves and recesses for receiving other components of the relay. As in the previous embodiments, a core yoke element 64 having a core leg 65 and a yoke leg 66 is provided, the yoke leg 66 being in a plane perpendicular to the plane containing the core leg 65, being rotated through 90° at a bend 67. The yoke leg 66 is centrally disposed above the core leg 65. The free end of the yoke leg 66 has a projection 68 which is angled downwardly so as to provide a bearing surface 69 for an armature 70 at the interior thereof. The armature 70 is also slightly angled with a bearing section 70*a* forming a bearing blade 70*b*, and a lower section 70*c* forming the working air gap with the core leg 65. Because the armature 70 is angled, its rotational axis is disposed outside of the plane defined by the pole face of the core leg 65 and the stationary contact element 74. During switching, this results in a friction effect having a selfcleaning effect of the contact location. A leaf spring 71 has an upper region 71*a* attached to the yoke leg 66, a central region 71*b* connected to the armature, and a free end 71*c* which carries a contact pad 72. The contact pad 72 is disposed opposite a contact pad 73 of the stationary cooperating contact element 74. The stationary contact element 74 is plugged into the coil body flange 62 as described in the earlier embodiments.

In the embodiment of FIGS. 13 through 17, the terminal element 75 for the leaf spring 71 is not fashioned of one piece with the core yoke element 64, but is instead formed as an additional part and is subsequently attached thereto. The connection terminal 75 has a number of angles and crimps between a fastening end 75*b* and a terminal end 75*a*, and is thereby held in recesses of the coil body such that the terminal end 75*a* is disposed in the same plane as the stationary contact element 74. The terminal ends 76*a* and 77*a* of respective coil connection elements 76 and 77 are respectively received in recesses 78 and 79 of the coil flange 63, also coplanar with the terminal ends 74*a* and 75*a*. The relay, thus, has outwardly directed terminal pins which are all aligned within the same plane.

A two-piece housing consisting of two halves 80 and 81 with a perpendicular separating plane covers the relay. Each half 80 and 81 has a plurality of recesses 82 therein at a lower portion thereof which, in combination, form openings through which the terminal elements 74*a*, 75*a*, 76*a* and 77*a* extend and are clamped. The housing can be sealed by applying a sealing compound along the separating seam. At its upper side, the housing has a gripping element 83 which facilitates pulling the relay out of a mount.

Figure 12:
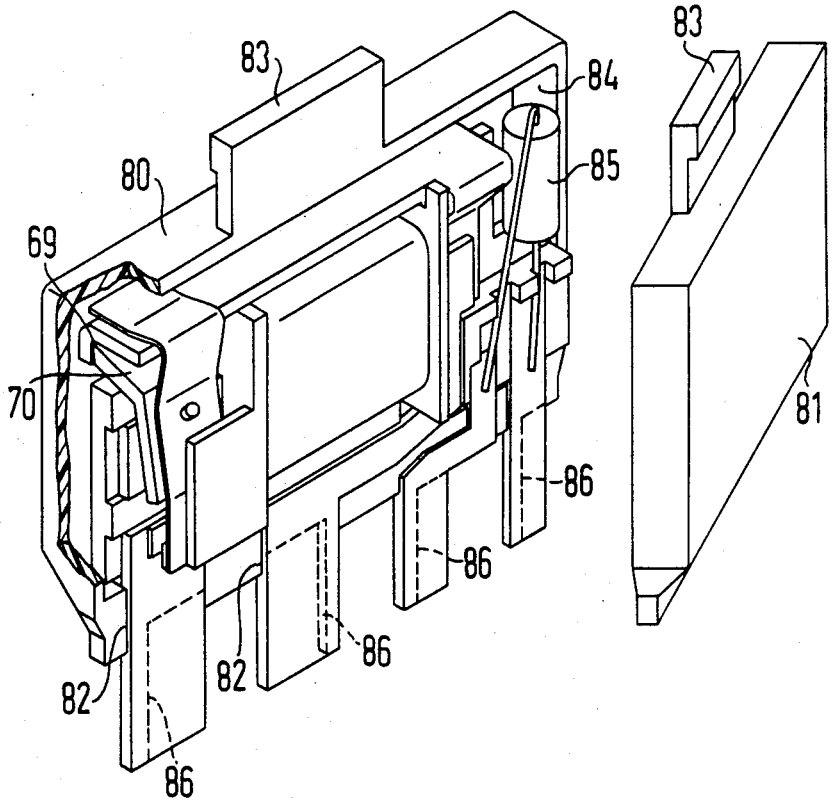
FIG. 12 is a perspective view of a third embodiment of an electromagnetic relay constructed in accordance with the principles of the present invention with a portion of the housing separated.
Figures 13, 14, 15, 16:
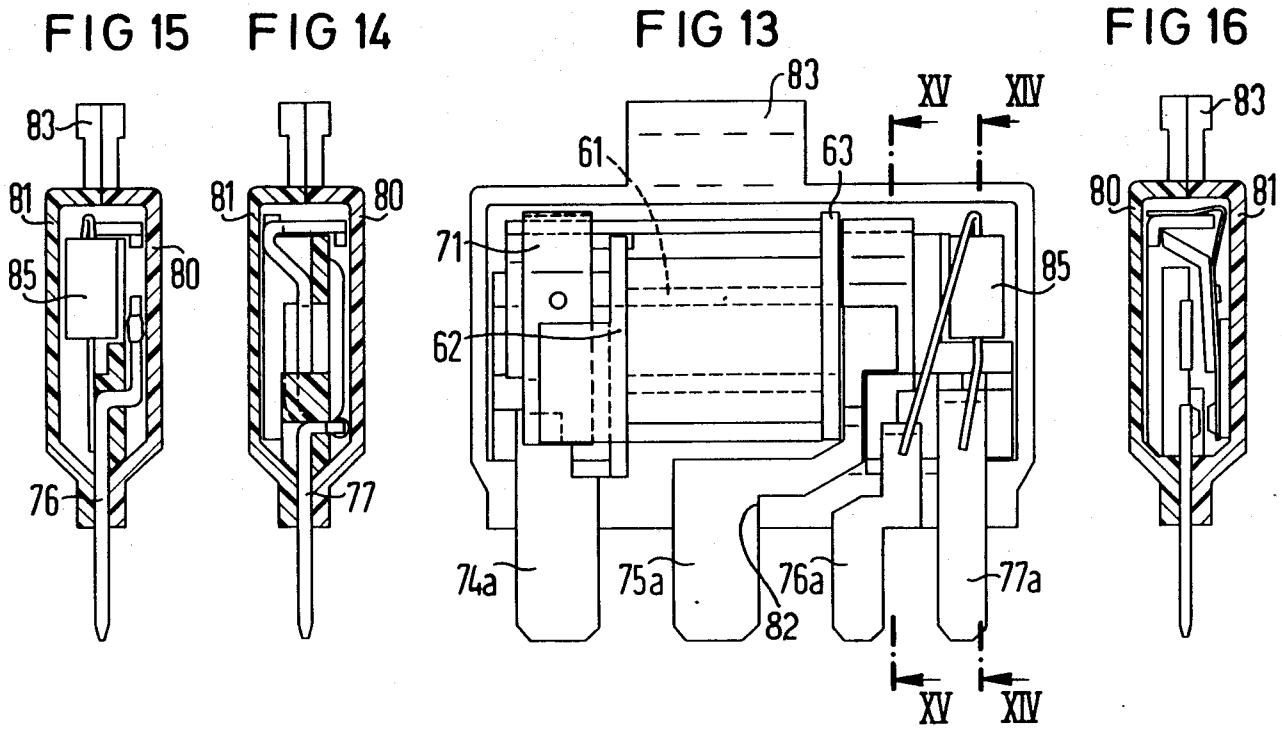
FIG. 13 is a side view of one half of the electromagnetic relay shown in FIG. 12.
FIG. 14 is a sectional view taken along lines XIV—XIV of FIG. 13.
FIG. 15 is a sectional view taken along line XV—XV of FIG. 13.
FIG. 16 is a further sectional view of the relay shown in FIG. 13.
Figure 17:
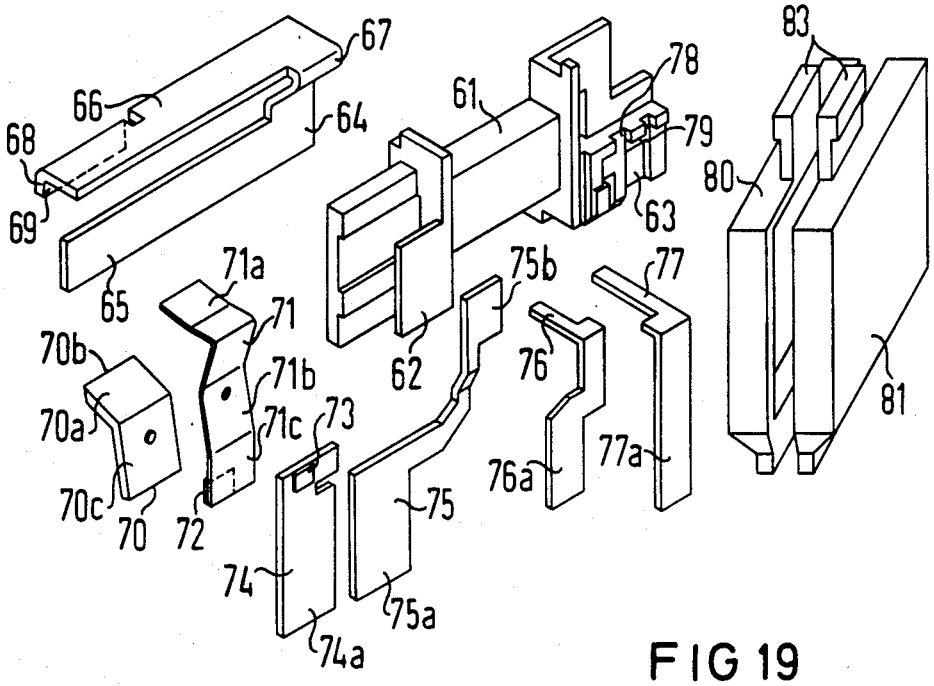
FIG. 17 is an exploded view of the relay assembly shown in FIG. 12.

A further space 84 is reserved within the housing, as shown in FIG. 12, in the region of the coil flange 63 for receiving an additional component therein. For example, a capacitor 85 may be connected between the coil terminals.

Instead of the terminal elements 74*a*, 75*a*, 76*a* and 77*a* in the form of plugs, those terminal elements may be solder pins. Such solder connections can be formed, for example, by partial separation of the terminals along the dashed lines 86 shown in FIG. 12.

Figure 18:
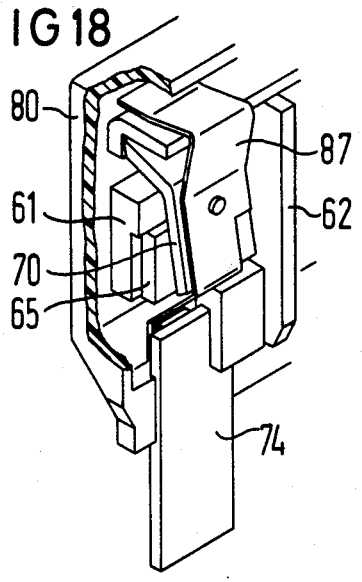
FIG. 18 is a perspective view, partly broken away, of a portion of the relay shown in FIG. 12 in a further embodiment.
Figure 19:
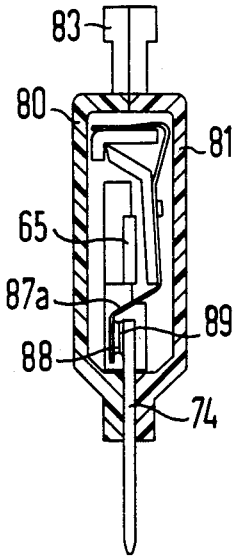
FIG. 19 is a sectional view showing the embodiment of FIG. 18.

A further modification of the embodiment of the relay of FIG. 12 is shown in FIGS. 18 and 19. The armature 70 in this modification is provided with a modified leaf spring 87 having a free end 87*a* crimped and conducted between the core leg 65 and the stationary contact element 74, so that the contact pad 88 carried thereon forms a normally closed connection with a contact pad 89 of the stationary contact element 74. The remainder of the relay is constructed as shown in FIGS. 12 through 17.

It will be recognized by those skilled in the art that other modifications may be undertaken without departing from the inventive concept disclosed herein. For example, a flat relay structure may be obtained using the embodiment of FIGS. 12 through 17 combined with the principles of contstruction shown in the embodiment of FIGS. 6 through 11.

Other modifications may be suggested by those skilled in the art, however, it is the intention of the inventor to embody within the patent warranted hereon all changes and modifications as reasonably and properly come within the scope of his contribution to the art.

I claim as my invention:

1. An electromagnetic relay having a terminal plane and comprising:

a hollow coil body carrying an excitation coil with a coil axis extending parallel to said terminal plane;

a one-piece flat stock core yoke element having at least a yoke leg and a core leg, said core yoke element being bent and crimped such that said yoke leg is disposed in a plane substantially perpendicular to the plane of said core leg and said yoke leg having a center line in said plane of said core leg, said core leg extending axially through said coil and having an exposed free end held by said coil body, and said yoke leg being disposed outside of and adjacent to said coil;

a leaf spring with an armature and a contact pad mounted thereon;

means for mounting said leaf spring for pivotal movement around an axis parallel to said coil axis such that said armature forms a working gap with said free end of said core leg; and a stationary contact element anchored in said terminal plane disposed for making and breaking with said contact pad upon movement of said leaf spring.

2. A relay as claimed in claim 1, wherein said core leg is disposed perpendicularly with respect to said terminal plane of said relay.

3. A relay as claimed in claim 2, further comprising respective connection elements for said leaf spring and for said stationary contact element, said connection elements being disposed in the same plane as said core leg.

4. A relay as claimed in claim 3, further comprising:

a connection leg formed on said core yoke element extending outside of said coil parallel to and coplanar with said core leg; and a tab extending from said connection leg into said terminal plane of said relay forming said connection element for said leaf spring.

5. A relay as claimed in claim 4, wherein said coil body has a groove in which said connection leg is received and held.

6. A relay as claimed in claim 3, wherein said connection element for said leaf spring is part of a separate element attached to said core yoke element, said separate element having a lower portion forming said connection element and an upper portion attached to said core yoke element.

7. A relay as claimed in claim 1, wherein said core leg, said armature and said stationary contact element are all disposed parallel to said terminal plane of said relay.

8. A relay as claimed in claim 7, further comprising:

a connection element for said stationary contact element disposed perpendicularly with respect to said stationary contact element and said terminal plane; and a connection element for said leaf spring integrally formed on said yoke leg coplanar therewith and perpendicular to said terminal plane of said relay.

9. A relay as claimed in claim 1, further comprising a seating edge on said coil body against which said armature pivots, said seating edge being disposed adjacent said free end of said yoke leg.

10. A relay as claimed in claim 1, further comprising two coil connection elements; and two spaced coil flanges carried on said coil body, one of said coil flanges having a plurality of plug-in grooves for receiving said stationary cooperating contact element and said core yoke element, and the other of said flanges having a plurality of plug-in grooves for respectively receiving and holding said two coil connection elements.

11. A relay as claimed in claim 10, further comprising a relay base having a plurality of openings therein through which all of said connection elements extend.

12. A relay as claimed in claim 1, wherein said yoke leg has a laterally bent tab at a free end thereof forming a bearing notch for said armature, and said armature having a bearing blade received in said bearing notch.

13. A relay as claimed in claim 12, wherein said bearing notch is disposed outside of the plane containing said core leg and said armature, and wherein said bearing blade is carried on an angled section of said armature.

14. An electromagnetic relay comprising:

a base;

a coil body having spaced flanges with an excitation coil wound on said body between said flanges;

a pair of coil connection element received and held in respective grooves in one of said flanges and extending through said base;

a core yoke element having a core leg disposed perpendicular to said base and having a central axis parallel to said base, a connection leg coplanar with said core leg with a connection element extending perpendicularly therefrom through said base, and a yoke leg disposed perpendicular to said core leg and parallel to said base with a center line in the plane of said core leg;

a leaf spring connected to said yoke leg and having an armature carried thereon substantially perpendicular to said base and forming a working air gap with a free end of said core leg, said leaf spring also having a contact pad thereon;

a mount for one end of said armature on the other of said coil flanges for pivoting said armature about an axis parallel to said base; and a stationary contact element disposed perpendicularly to said base having a contact pad disposed for making and breaking with said leaf spring contact pad, said core yoke element, said stationary contact element and said leaf spring being received in respective grooves in said other of said flanges.

15. An electromagnetic relay comprising:

a base;

a coil body having spaced flanges with an excitation coil wound on said body between said flanges;

a pair of coil connection elements received and held in respective grooves in one of said flanges and extending through said base;

a core yoke element having a core leg disposed parallel to said base and having a central axis parallel to said base, and a core leg disposed perpendicularly to said core leg and perpendicularly to said base with a center line in the plane of said core leg and having a terminal integrally formed thereon extending perpendicularly through said base;

a leaf spring connected to said yoke leg and having an armature carried thereon substantially parallel to said base and forming a working air gap with a free end of said core leg, said leaf spring also having a contact pad thereon;

a mount for one end of said armature on the other of said coil flanges for pivoting said armature about an axis parallel to said base; and a stationary contact element disposed parallel to said base having a contact pad disposed for making and breaking with said leaf spring contact pad and further having a terminal extending perpendicularly through said base, said core yoke element, said stationary element and said leaf spring being received in respective grooves in said other of said flanges.

16. An electromagnetic relay comprising:

two housing halves joinable to form a housing for said relay defining a terminal plane;

a coil body in said housing having spaced flanges with an excitation coil wound on said body between said flanges;

a pair of coil connection elements received and held in respective grooves in one of said flanges and extending though said terminal plane;

a core yoke element having a core leg disposed perpendicularly to said terminal plane and having a central axis parallel to said terminal plane and a yoke leg disposed perpendicularly to said core leg and parallel to said terminal plane with a center line in the plane of said core leg;

a leaf spring connected to said yoke leg and having an armature carried thereon substantially perpendicular to said terminal plane and forming a working air gap with a free end of said core leg, said leaf spring also having a contact pad thereon;

a mount for one end of said armature on the other of said coil flanges for pivoting said armature about an axis parallel to said terminal plane;

a stationary contact element disposed perpendicularly to said terminal plane and having a contact pad disposed for making and breaking with said leaf spring contact pad; and a connection element for said leaf spring having a lower terminal portion extending through said terminal plane and having an upper portion attached to said yoke leg, said core yoke element, said stationary contact element and said leaf spring being received in respective grooves in said other of said flanges..

17. An electromagnetic relay as claimed in claim 16, wherein said coil connection elements, said terminal portion of said connection element and said stationary contact element being disposed coplanar in a plane substantially perpendicular to said terminal plane.

18. An electromagnetic relay as claimed in claim 17, further comprising:

an angled tab at a free end of said yoke leg forming a bearing notch; and a bearing blade on said armature received in said notch about which said armature pivots, said armature having an angled portion projecting away from said leaf spring on which said bearing blade is carried.

* * * * *